US006084192A

United States Patent [19]

Honma

[11] Patent Number: 6,084,192

[45] Date of Patent: Jul. 4, 2000

[54] SLIDE KNOB MOUNTING STRUCTURE

[75] Inventor: Yasuyuki Honma, Shizuoka, Japan

[73] Assignee: NEC Corporation, Tokyo, Japan

[21] Appl. No.: 09/200,582

[22] Filed: Nov. 27, 1998

[30] Foreign Application Priority Data

Nov. 27, 1997 [JP] Japan ..... 9-326704

[51] Int. Cl.[7] ..... H01H 15/24

[52] U.S. Cl. ..... 200/547; 200/332.1; 74/527

[58] Field of Search ..... 200/547, 332.1, 200/332.2; 74/527, 531

[56] References Cited

U.S. PATENT DOCUMENTS 3,369,100 2/1968 Kussy et al. ..... 200/547 X 4,190,754 2/1980 Kilar ..... 74/527 X 4,421,964 12/1983 Buchtel ..... 200/332.2

4,982,062 1/1991 Huerre et al. ..... 200/332.1 X

FOREIGN PATENT DOCUMENTS 5-18074 3/1993 Japan .

*Primary Examiner*—Renee Luebke

*Attorney, Agent, or Firm*—Scully, Scott, Murphy & Presser

[57] ABSTRACT

A structure for mounting a slide knob included in, e.g., a portable apparatus is disclosed. The structure of the present invention allows a slide knob to be mounted to the apparatus without resorting to screws and therefore reduces the number of assembling steps and the number of parts.

4 Claims, 3 Drawing Sheets

SLIDE KNOB MOUNTING STRUCTURE

BACKGROUND OF THE INVENTION

The present invention relates to a structure for mounting a slide knob and more particularly to a structure for mounting a miniature slide knob included in, e.g., a portable apparatus.

It is a common practice with a portable apparatus to mount a slide knob on the front or the rear of the apparatus in order to allow the user to operate a slide switch, slide volume or similar slidable electronic part disposed in the apparatus via the knob. Specifically, the slide knob includes a thumb piece protruding from, e.g., the rear of the apparatus and a pair of lugs positioned below the thumb piece. A slide switch, for example, has its knob positioned between the lugs of the slide knob. The user causes the slide switch to slide by nipping and sliding the thumb piece.

However, the problem with the conventional mounting structure is that it affixes the slide knob to the apparatus by use of screws, increasing the number of assembling steps and cost. Should the screws be replaced with an adhesive tape, the connection between the slide knob and the apparatus would be lowered as to durability.

Technologies relating to the present invention are also disclosed in, e.g., Japanese Utility Model Laid-Open Publication No. 5-18074.

To better understand the present invention, brief reference will be made to a conventional slide knob mounting structure, shown in FIGS. 1 and 2. As shown, the structure includes a slide knob 25 mounted on the inside of a casing 21 included in a portable apparatus not shown. The slide knob 25 includes a thumb piece 25*a* and a pair of lugs for holding, e.g., the knob of a slide switch, not shown, therebetween. A plate 28 is formed with two screw holes 29 and used to retain the slide knob 25 on the casing 21.

To mount to the slide knob 25 to the casing 21, a thumb piece 25*a* is inserted into a window 23 formed in the casing 21, and then the plate 28 is laid on the knob 25. Subsequently, screws 30 are respectively driven into a pair of threaded hole members 24 via the screw holes 29 of the plate 28, thereby fastening the slide knob 25 to the casing 21. The screws 30 are sometimes replaced with an adhesive tape. A slide switch is mounted on a printed circuit board and slidable in opposite directions, although not shown specifically. A knob included in the slide switch is positioned between the lugs 25*b* of the slide knob 25. The user of the portable apparatus may operate the slide switch by nipping and sliding the thumb piece 25*a* in a desired direction.

The above conventional structure has some problems left unsolved, as discussed earlier.

SUMMARY OF THE INVENTION

It is therefore an object of the present invention to provide a slide knob mounting structure capable of mounting a slide knob without resorting to screws and thereby reducing the number of assembling steps and the number of parts.

In accordance with the present invention, in a structure in which a knob of an electronic part mounted on a circuit board within a casing and slidable in opposite directions is caused to slide via a knob portion protruding from a window formed in the casing, the knob portion includes a slide knob including a rectangular plate, a thumb piece formed on one major surface of the plate and protruding from the window, and a pair of lugs formed on the other major surface of the plate. A pair of bearing members are affixed to the inside of the casing at both sides of the window, and each has a rectangular hole. The slide knob is positioned between the bearing members in a preselected position. A stop includes a pair of parallel arms each having a respective locking end. The stop is inserted into the holes of the bearing members with the locking ends of the arms at the head in such a manner as to press the slide knob. The locking ends prevent the slide knob from slipping out while the arms allow the slide knob to slide.

Also, in accordance with the present invention, in a structure in which a knob of an electronic part mounted on a circuit board within a casing and slidable in opposite directions is caused to slide via a knob portion protruding from a window formed in the casing, the knob portion includes a slide knob including a rectangular plate, a thumb piece formed on one major surface of the plate and protruding from the window, and a pair of lugs formed on the other major surface of the plate. A first and a second pair of parallel arms respectively extend out from opposite ends of the plate, and each includes a respective locking end. A pair of bearing members are affixed to the inside of the casing at both sides of the window, and each has a rectangular hole. After the locking ends of either one of the first and second pairs of arms have been inserted into the hole of one of the pair of bearing members, the locking ends of the other pair of arms are inserted into the hole of the other bearing member while being elastically deformed with the thumb piece protruding to the outside via the window. The slide knob is allowed to slide while being prevented from slipping out by the locking ends.

BRIEF DESCRIPTION OF THE DRAWINGS

The above and other objects, features and advantages of the present invention will become more apparent from the following detailed description taken with the accompanying drawings in which.

In the drawings, identical reference numerals designate identical structural elements.

DESCRIPTION OF THE PREFERRED EMBODIMENTS

Figure 1:
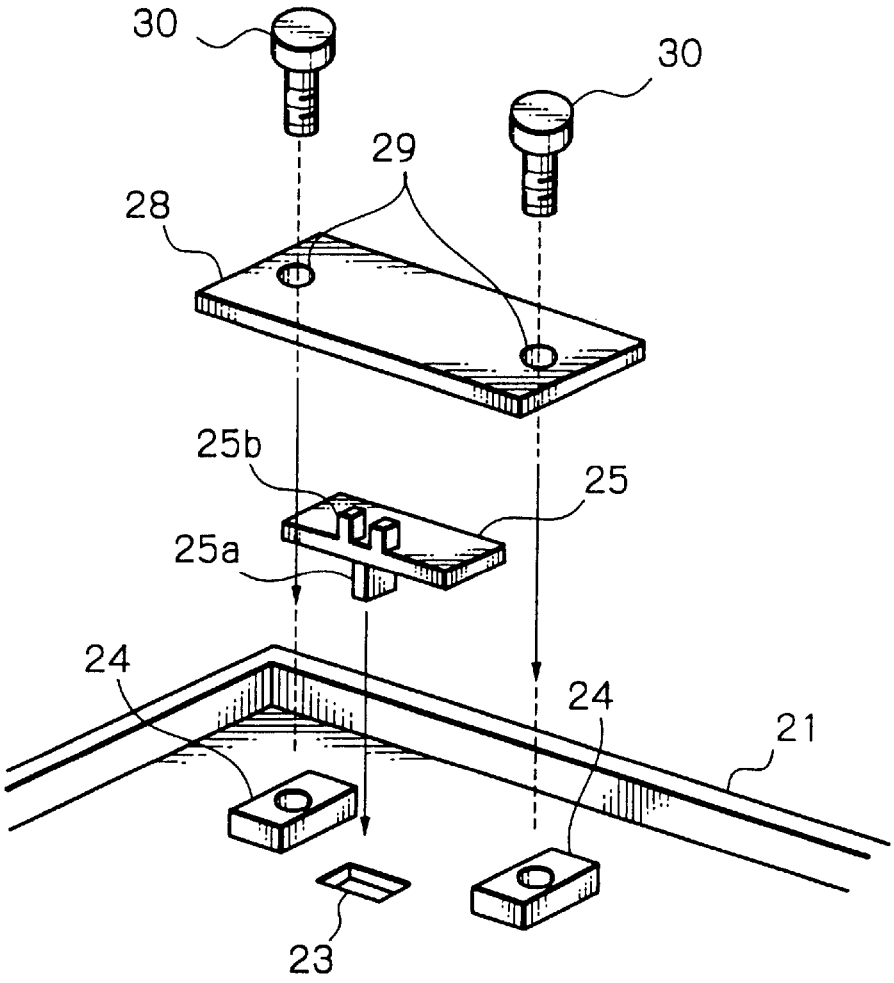
Fig. 1 PRIOR ART
FIG. 1 is an exploded perspective view showing a conventional slide knob mounting structure.
Figure 2:
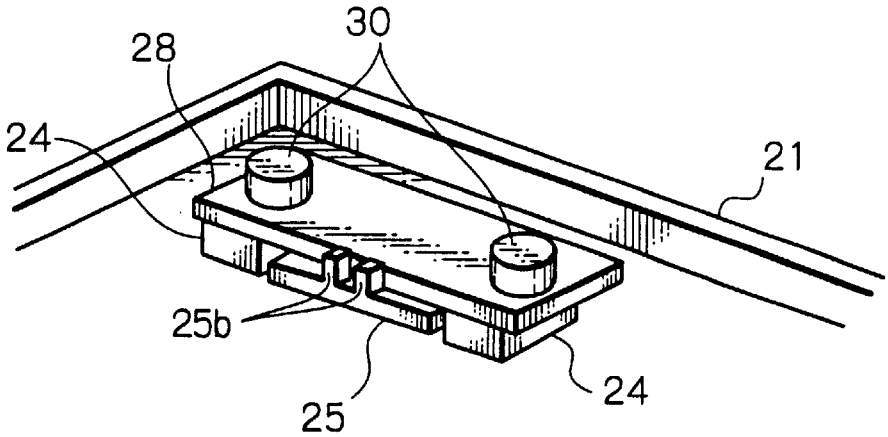
Fig. 2 PRIOR ART
FIG. 2 is a perspective view showing the structure of FIG. 1 in an assembled condition.
Figure 3:
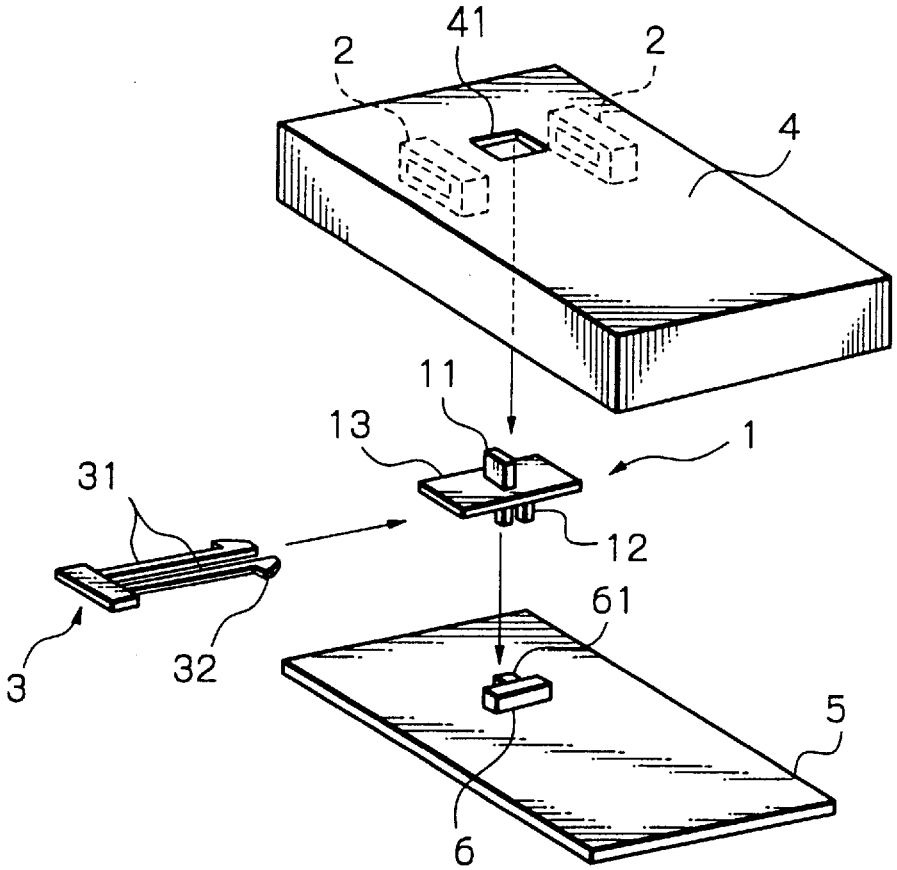
FIG. 3 is an exploded perspective view showing a slide knob mounting structure embodying the present invention.
Figure 4:
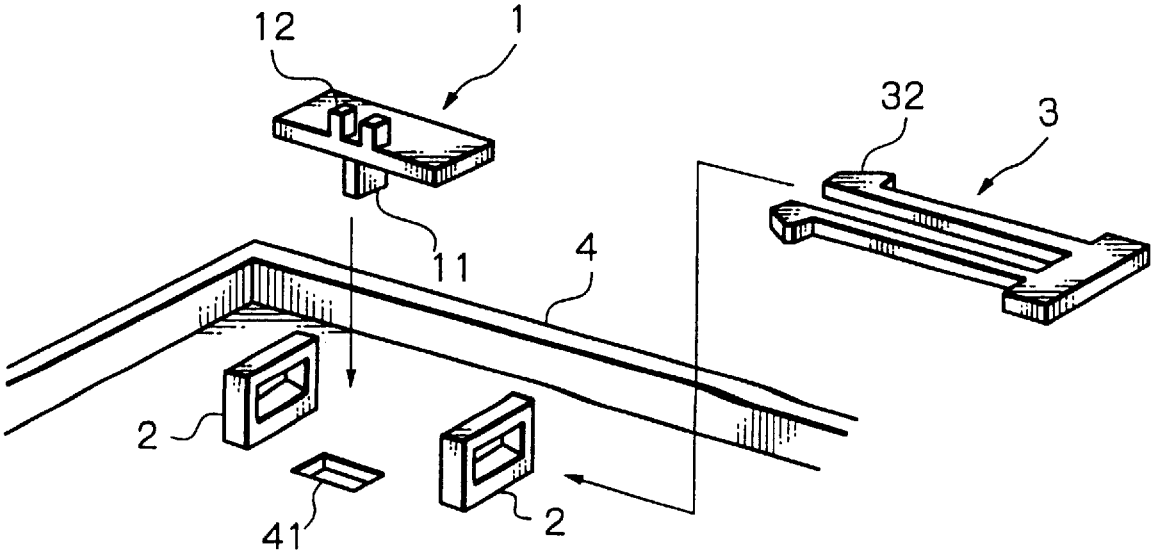
FIG. 4 is a fragmentary perspective view showing the structure of FIG. 3.
Figure 5:
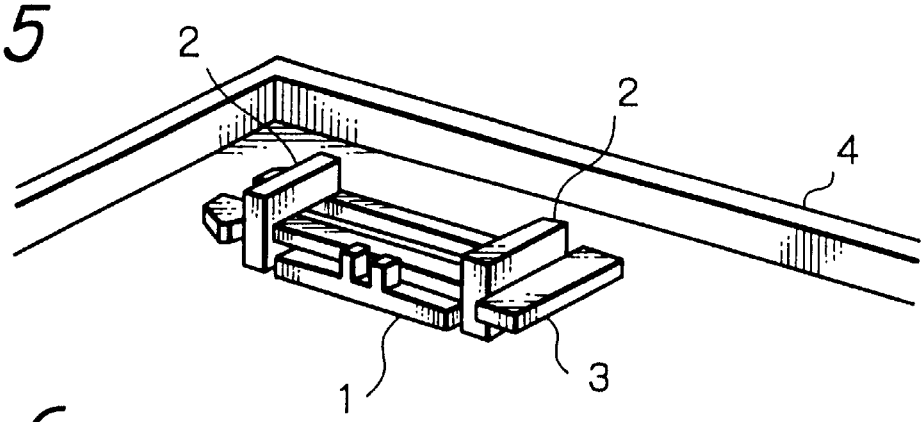
FIG. 5 is a perspective view showing the structure of FIG. 3 in an assembled condition.

Referring to FIGS. 3, 4 and 5, a slide knob mounting structure embodying the present invention will be described. As shown, a slide knob 1 includes a rectangular plate 13, a thumb piece 11 formed on one major surface of the plate 13, and a pair of lugs 12 formed on the other major surface of the plate 13. A casing 4 is included in a portable apparatus, not shown, and formed with a window 41. A pair of bearing members 2 are soldered or otherwise affixed to the inside of the casing 4 at both sides of the window 41. Each bearing member 2 is formed with a rectangular hole.

A slide switch 6 is mounted on a printed circuit board 5 disposed in the casing 4 and includes a knob 61. The slide switch 6 is slidable in opposite directions via the knob 61.

The slide knob 1 is mounted on the inside of the casing 4 with the thumb piece 11 protruding to the outside via the window 41. The knob 61 of the slide switch 6 is positioned between the lugs 12 of the slide knob 1.

A bifurcated stop 3 has two parallel elastic arms 31 each having a locking end 32. The stop 3 is implemented as a single elastic molding.

The slide knob 1 is mounted to the casing 4 by the following procedure. First, the slide knob 1 is positioned between the two bearing members 2 with the thumb piece 11 protruding to the outside via the window 41. Subsequently, the arms 31 of the stop 3 are inserted into the hole of the right bearing member 2, as viewed in FIG. 4, and then into the hole of the left bearing member 2, as viewed in FIG. 4, until their locking ends 32 have been brought into locking engagement with the left bearing member 2. Specifically, the locking ends 32 passed through the hole are elastically opened away from each other.

In the above structure, the user of the apparatus may slide the knob 61 of the slide switch 6 via the thumb piece 11 of the slide knob 1. The elastic arms 31 of the stop 31 allow the slide knob 1 to slide, but prevent it from slipping out. Specifically, the arms 31 press the plate 13 toward the casing 4.

Figure 6:
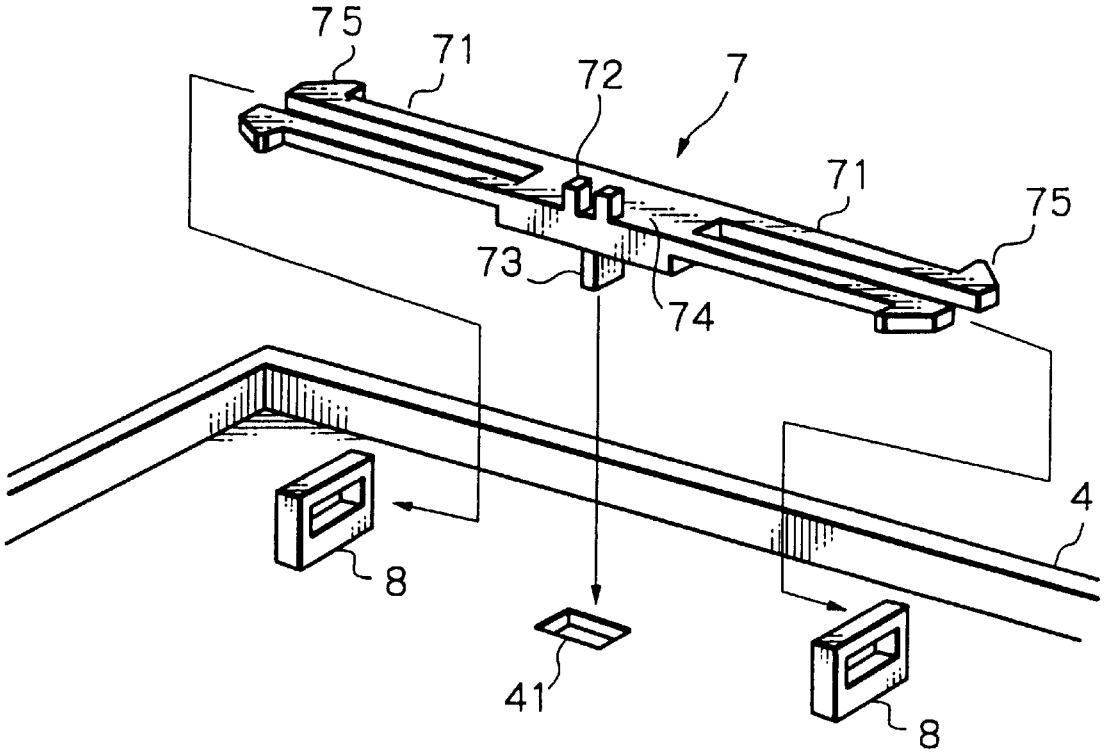
FIG. 6 is an exploded perspective view showing in alternative embodiment of the present invention.
Figure 7:
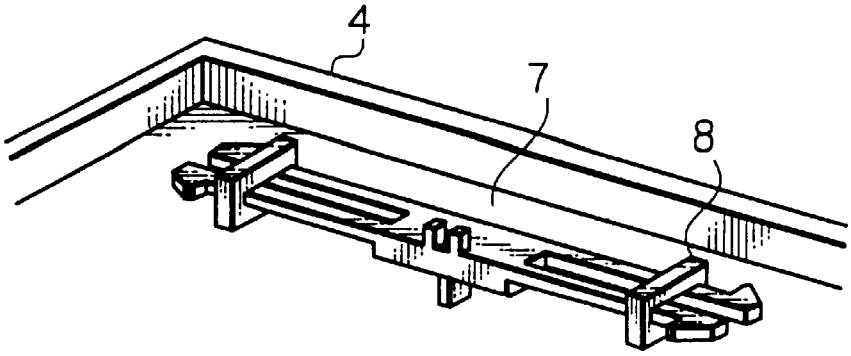
FIG. 7 is a perspective view showing the alternative embodiment in an assembled condition.

An alternative embodiment of the present invention will be described with reference to FIGS. 6 and 7. As shown, a slide knob 7 includes a rectangular plate 74, a thumb piece 73 formed on one major surface of the plate 74, a pair of lugs 72 formed on the other major surface of the plate 74, and two pairs of elastic arms 71 extending out from both ends of the plate 74, as illustrated. Each arm 71 has a locking end 75. A pair of bearing members 8 are welded to or otherwise affixed to the inside of the casing 4 at both sides of the window 41. The slide knob 7 is implemented as an elastic molding.

In assembly, the locking ends 75 of the elastic arms 71 extending out from one end of the slide knob 7 are inserted into the hole of one bearing member 8. Then, the locking ends 75 of the elastic arms 71 extending out from the other end of the slide knob 7 are inserted into the hole of the other bearing member 8 while being elastically deformed with the thumb piece 73 protruding to the outside via the window 41. The locking ends 75 passed through the hole of the associated bearing member 8 are elastically opened sway from each other. As a result, the slide knob 7 is slidable on the casing 4, but is surely prevented from slipping out.

This embodiment is advantageous over the previous embodiment in that the slide knob 7 plays the role of a stop itself and thereby reduces the number of parts and cost.

In summary, it will be seen that the present invention provides a slide knob mounting structure capable of mounting a slide knob without resorting to screws and therefore reducing the number of assembling steps and the number of parts.

Various modifications will become possible for those skilled in the art after receiving the teachings of the present disclosure without departing from the scope thereof.

What is claimed is:

1. A slide knob structure in which a knob of an electronic part is mounted on a circuit board within a casing, said knob being slidable in opposite directions via a thumb piece protruding from a window formed in said casing, said slide knob structure comprising:

a slide knob including a rectangular plate, the thumb piece being formed on one major surface of said plate and protruding from the window, and a pair of lugs formed on the other major surface of said plate;

a pair of bearing members affixed to an inside of the casing at both sides of the window and each having a rectangular hole, said slide knob being positioned between said pair of bearing members in a preselected position; and a stop including a pair of parallel arms each having a respective locking end;

wherein said stop is inserted into the holes of said pair of bearing members with the locking ends of said pair of arms at the head in such a manner as to press said slide knob, whereby said locking ends prevent said slide knob from slipping out while said pair of arms allow said slide knob to slide.

2. A structure as claimed in claim 1, wherein said stop comprises an elastic molding.

3. A slide knob structure in which a knob of an electronic part is mounted on a circuit board within a casing, said knob being slidable in opposite directions via a thumb piece protruding from a window formed in said casing, said slide knob structure comprising:

a slide knob including a rectangular plate, the thumb piece being formed on one major surface of said plate and protruding from the window, and a pair of lugs formed on the other major surface of said plate;

a first and second pair of parallel arms respectively extending out from opposite ends of said plate, said arms each including a respective locking end; and a pair of bearing members affixed to an inside of the casing at both sides of the window and each having a rectangular hole;

wherein after the locking ends of either one of said first and second pairs of arms have been inserted into the hole of one of said pair of bearing members, the locking ends of the other pair of arms are inserted into the hole of the other bearing member while being elastically deformed with said thumb piece protruding to an outside via the window, whereby said slide knob is allowed to slide while being prevented from slipping out by said locking ends.

4. A structure as claimed in claim 3, wherein said slide knob and said first and second pairs of arms are implemented as a single molding.

* * * * *